United States Patent [19]

Inada et al.

[11] 4,325,047

[45] Apr. 13, 1982

[54] TEMPERATURE RESPONSIVE SWITCH

[75] Inventors: Masami Inada, Kariya; Nobuyuki Hashimoto; Atsushi Satomoto, both of Toyota, all of Japan

[73] Assignee: Aisin Seiki Kabushiki Kaisha, Kariya, Japan

[21] Appl. No.: 248,117

[22] Filed: Mar. 27, 1981

[30] Foreign Application Priority Data

Apr. 9, 1980 [JP] Japan ..... 55-47419
Apr. 9, 1980 [JP] Japan ..... 55-47420

[51] Int. Cl.[3] ..... H01H 37/52
[52] U.S. Cl. ..... 337/370; 337/371
[58] Field of Search ..... 337/362, 363, 364, 365, 337/367, 368, 370, 371, 348

[56] References Cited

U.S. PATENT DOCUMENTS 3,943,480 3/1976 Schmitt ..... 337/371
4,035,756 7/1977 Schmitt ..... 337/370
4,092,624 5/1978 Tomoyoshi ..... 337/371 X
4,198,616 4/1980 De Filippis ..... 337/371
4,218,670 8/1980 Watanabe ..... 337/367

*Primary Examiner*—George Harris
*Attorney, Agent, or Firm*—Sughrue, Mion, Zinn, Macpeak & Seas

[57] ABSTRACT

A temperature responsive switch is provided which comprises a pair of bimetal discs having different temperature-deformation characteristics, a pair of fixed electrical contacts and a movable electrical contact. The movable contact engages one of the fixed contacts in response to a deformation of the pair of bimetal discs or remain free from engagement with either fixed contact. The engagement of the movable contact with one or the other of the fixed contacts and the absence of its engagement with either fixed contact constitute three conditionswhich permits a detection of a temperature of at least three different regions.

16 Claims, 23 Drawing Figures

14
B
13
14₂
10
12
15
1
8
2
4
3
5
C
A
9₁
9₂
7
6

6

4

TEMPERATURE RESPONSIVE SWITCH

BACKGROUND OF THE INVENTION

The invention relates to a temperature responsive switch, and more particularly, to a temperature responsive switch which may be used to control the temperature responses of automobiles, for example, the recirculation of exhaust gas, or ignition timing in accordance with the temperature of an engine.

For on-board purification of an exhaust gas of an automobile, the recirculation of an exhaust gas or an ignition timing is controlled in accordance with the temperature of an engine or of an exhaust gas. In such control, the engine temperature or the temperature of the exhaust gas is detected by a temperature responsive switch. In these applications, a temperature responsive switch includes a bimetal as a temperature responsive element which becomes deformed to open or close switch contacts in accordance with the temperature which the bimetal assumes. Accordingly, an on-off operation may be achieved as by closing or opening the contacts below and above a given temperature, for example.

Since the control of the recirculation of the exhaust gas or the ignition timing increases the exhaust gas processing efficiency, the recent trend is from an on-off control (two-value control) to a multi-value control. In a multi-value control, the temperature range of the engine or the exhaust gas is divided into at least three regions of low, medium and high temperatures, in each of which a separate processing of the exhaust gas or a separate control of the ignition timing is made. Accordingly, at least two temperature responsive switches having different switching points are utilized in a multi-value control. As a result of the requirements imposed on such temperature responsive switches, including the resistance to high temperatures and to shocks, the switch is formed as a rigid structure, resulting in a bulky construction. Hence, the provision of two or more temperature responsive switches on a vehicle results in an increased space requirement and an increased assembling operation.

SUMMARY OF THE INVENTION

It is an object of the invention to provide a temperature responsive switch capable of detecting temperatures in at least three regions.

In accordance with the invention, at least two bimetals having different temperature-deformation characteristics with a spacer interposed therebetween are disposed within a casing together with an actuator guide so as to be displaceable in the axial direction of the casing. One of the bimetals is formed with an opening through which an actuator rod extends in alignment with the axis, with one end of the actuator rod being supported by the other bimetal. The actuator rod extends through the actuator guide and has its other end projecting out of the guide. The other bimetal is supported by a spring member. The spring member undergoes an expansion or shrinkage and the actuator rod moves axially of the casing, both in accordance with the deformation of the bimetals. At least three electrical contacts which are electrically insulated from each other are disposed within the space of the casing, into which the other end of the actuator rod projects from the actuator guide, and they are located on a straight line which is parallel to the axis of the casing. The central one of the contacts is fixedly mounted on one end of a spring switch arm which is located on the path of movement of the other end of the actuator rod. The other end of the spring switch arm is disposed in contact with the casing. Assuming that the casing represents a ground level, the contact on the spring switch arm engages one of the two remaining contacts which then assumes a ground level while the other assumes an insulated level (a first condition) if the actuator rod is removed from the spring switch arm. When the actuator rod causes a small displacement of the spring switch arm, the contact on the arm moves away from said one contact, whereby the both contacts assume an insulated level (second condition). When the actuator rod causes a further displacement of the spring switch arm, the contact on the arm engages the other of the two remaining contacts, one of which assumes a ground level while the other is maintained at an insulated level (a third condition). The actuator rod is displaced in the manner mentioned above in accordance with the deformation of bimetals which occurs in accordance with a temperature change. In this manner, the temperature responsive switch is capable of detecting at least three different temperature regions.

DESCRIPTION OF PREFERRED EMBODIMENTS

Figure 1E:
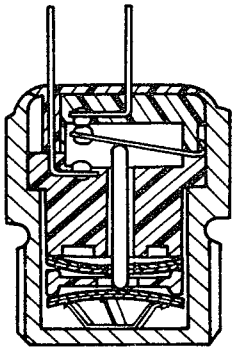
FIGS. 1*d* and 1*e* are longitudinal sections of the embodiment shown in FIG. 1*a,* illustrating different operative conditions.
Figure 1D:
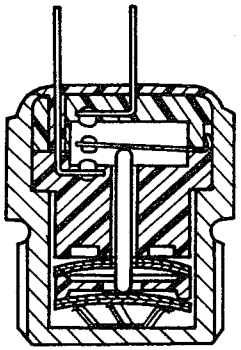
Figure 1A:
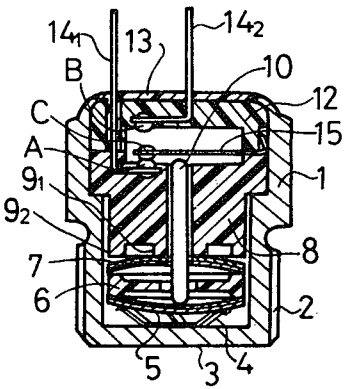
FIG. 1*a* is a longitudinal section of one embodiment of the invention.

Referring to FIG. 1*a* which shows a temperature responsive switch according to a first embodiment, there is shown a hollow casing 1 including a leg portion which is externally threaded as shown at 2 for threadable engagement with a threaded bore formed in a wall of a cooling water chamber of an engine. When the casing 1 is fixedly mounted on the engine, the bottom wall 3 of the casing is brought into contact with the cooling water. Disposed within the internal space of the casing 1 are a Belleville spring 4, a first bimetal disc 5, a spacer 6, a second bimetal disc 7 and an actuator guide 8 sequentially disposed from below in the sequence named. The casing 1 includes a top opening which receives a cover 12, the latter holding the guide 8. The upper edge of the casing 1 around the opening is inwardly caulked to the cover 12. In this manner, the casing 1, the guide 8 and the cover 12 are coupled together in an integral manner. The top surface of the cover 12 is coated with a sealing resin 13, which provides a hermetic seal between the edge of the opening formed in the casing 1 and the cover 12.

Figure 1B:
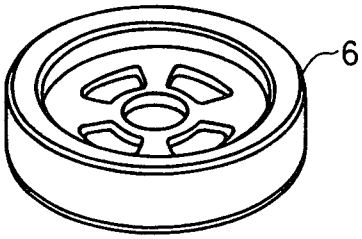
FIG. 1*b* is an enlarged perspective view of a spacer shown in FIG. 1*a;*
Figure 1C:
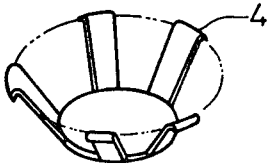
FIG. 1*c* is an enlarged perspective view of a spring member shown in FIG. 1*a;*

An enlarged perspective view of the spacer 6 is shown in FIG. 1*b* while an enlarged perspective view of the Belleville spring 4 is shown in FIG. 1*c*. The spacer 6 is in the form of a disc having annular projections on both its upper and lower surfaces, with an opening being centrally formed therein to permit the passage of an actuator rod 10. The Belleville spring 4 includes five limbs radially extending along a frusto-conical surface. These limbs contact the first bimetal disc while a flat disc portion to which the individual limbs are connected bears against the bottom wall 3. In this manner, the Belleville spring 4 supports the first bimetal disc 5 within the internal space of the casing 1.

Both the second bimetal disc 7 and the guide 8 are formed with openings through which the actuator rod 10 extends. As mentioned previously, the rod 10 also extends through the central opening formed in the spacer 6. Formed on the lower surface of the actuator guide 8 are an annular projection $9_1$ which constrains a displacement of a portion of the second bimetal disc around its central opening in a selected operation condition (see FIGS. 1*a* and 1*d*), and another annular projection $9_2$ which constrains a displacement of a portion of the second bimetal disc adjacent to its outer periphery in another operative condition (FIG. 1*e*).

A first lead strip $14_1$ is secured to the top surface of the actuator guide 8, and extends through the cover 12 and the seal resin 13 to the exterior of the casing 1. A second lead strip $14_2$ is secured to the inner surface of the cover 12, and also extends through the cover 12 and the seal resin 13 to the exterior of the casing 1. The ends of the first and the second lead strip $14_1$, $14_2$ which are located within the casing 1 are disposed in opposing relationship with each other with a given spacing therebetween and have a first fixed contact member A and a second fixed contact member B secured thereto. A spring switch arm 15 having a movable contact member C secured to one end thereof is fixedly mounted on the lower end face of the cover 12 so as to be located opposite to the top end of the actuator rod 10 with its contact C located intermediate the fixed contacts A and B. It will be noted that the end of the spring switch arm 15 remote from the contact member is folded to be disposed between the cover 12 and the internal surface of the casing 1 so as to be disposed in contact with the latter under its own resilience. It is to be noted that the spring switch arm 15 is normally urged so that the contact C thereof is resiliently pressed against the first fixed contact A.

In a temperature region which is considered as a standard condition of the water temperature of the engine for purpose of purification of the exhaust gas, which is hereafter referred to as a medium temperature region, the first and the second bimetal disc 5 and 7 assume condigurations illustrated in FIG. 1*d*. In a temperature region which is lower than the medium region, referred to hereafter as a low temperature region, they assume configurations illustrated in FIG. 1*a* while in a temperature region higher than the medium temperature region, hereafter referred to as a high temperature region, they assume configurations illustrated in FIG. 1*e*. As a result of interactions among these bimetal discs, Belleville spring 4, spacer 6, projections $9_1$, $9_2$ on the guide 8, actuator rod 10 and the spring switch arm 15, a switching operation takes place in dependence upon the temperature region as indicated in Table 1 below in which it is assumed that the casing 1 assumes a ground potential.

TABLE 1

| Temperature region | Fig. | Potential of lead strips $14_1$ | $14_2$ |
|---|---|---|---|
| low | 1a | ground | X |
| medium | 1d | X | X |
| high | 1e | X | ground |

In the Table, X represents a potential which is applied to the lead strips $14_1$, $14_2$.

In the low temperature region as illustrated in FIG. 1*a*, the second bimetal disc 7 forces the spacer 6 down, which in turn forces the first bimetal disc 5 down, which then in turn forces the Belleville spring 4 down, with result that the Belleville spring 4 is compressed by a sum of the bending force applied by the first and the second bimetal disc, causing the actuator rod 10 to be displaced downward. Under the condition of the medium temperature region illustrated in FIG. 1*d*, the second bimetal disc is subjected to a bending of a lesser magnitude to permit an upward movement of the spacer 6. Also, the first bimetal disc flexes to the opposite side. Hence, the Belleville spring 4 is only subject to a reduced force from the second bimetal disc 7, allowing an expansion of the Belleville spring 4. As a result, the actuator rod 10 undergoes an upward movement through a distance which corresponds to the sum of the expansion of the Belleville spring 4 and a displacement of the first bimetal disc 5 in the upward direction which is caused by its inversion, raising the spring switch arm 15 to move the contact C away from the first fixed contact A. As the temperature further increases to reach the high temperature region, the second bimetal disc 7 also flexes to the opposite side, and hence the spacer 6 can move to its maximum extent, allowing a further expansion of the Belleville spring 4. Consequently, the actuator rod 10 raises the spring switch arm 15 further upward, bringing the contact C into engagement with the second fixed contact as shown in FIG. 1*e*. It is to be understood that the breadth of the individual temperature regions is determined by the spacing between the contacts A, B and the thickness of the contact C.

As discussed, in accordance with the invention, the single temperature responsive switch may be used to detect at least three temperature regions, as summarized in the Table 1. The lead strips $14_1$, $14_2$ may be utilized as terminals where the temperature region is detected to control the purification of the exhaust gas or the ignition timing in accordance with the potential detected, or they may be directly utilized as switch terminals which control the energization of an apparatus being controlled.

Figure 2A:
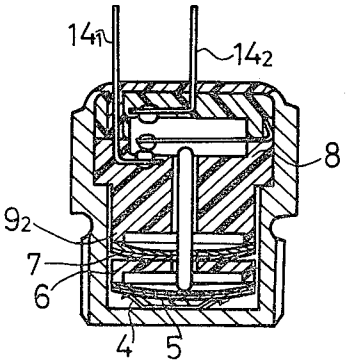
FIG. 2*a* is a longitudinal section of another embodiment of the invention.
Figure 2B:
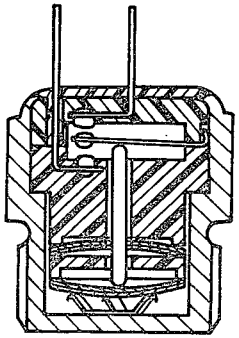
FIGS. 2*b* and 2*c* are longitudinal sections of the embodiment shown in FIG. 2*a,* illustrating different operative conditions.
Figure 2C:
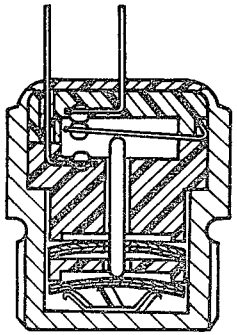

In an embodiment shown in FIG. 2*a*, the spacer 6 is provided with an annular projection only on its lower surface, and the actuator guide 8 is provided with an annular projection $9_2$ only around the outer periphery of the bottom thereof. The first bimetal disc 5 flexes to the opposite sides as a boundary between the medium and the high temperature region is passed in either direction. The second bimetal disc 7 forces the spacer 6 down only in the low temperature region and flexes to the opposite sides as a boundary between the low and the medium temperature region is passed in either direction. The condition assumed by the switch in the medium temperature region is indicated in FIG. 2*b* while that in the high temperature region is shown in FIG. 2*c*. The potential at the contacts A, B in this embodiment is as shown in the Table 1.

Figure 3A:
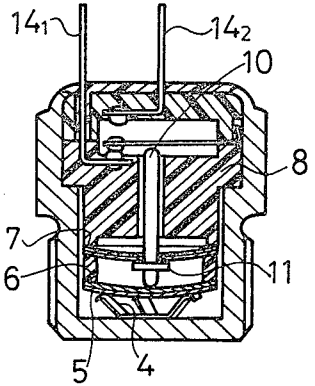
FIG. 3*a* is a longitudinal section of a further embodiment of the invention.
Figure 3B:
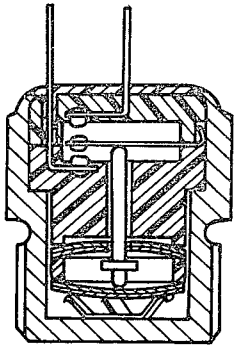
FIGS. 3*b* and 3*c* are similar longitudinal sections of the embodiment shown in FIG. 3*a,* illustrating different operative conditions.
Figure 3C:
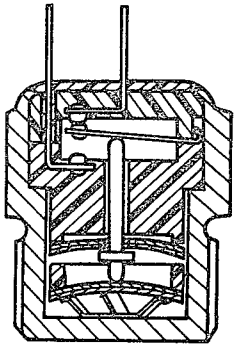

In an embodiment shown in FIG. 3*a*, the spacer 6 is in the form of a ring, and a flange 11 is formed on the actuator rod 10 toward its lower end. The first and the second bimetal disc 5 and 7 are of the same nature as those shown in FIG. 2*a*. In the low temperature region, the second bimetal disc 7 bears against the upper surface of the flange 11 as shown in FIG. 3*a*, thus forcing the actuator rod 10 down. In the medium and the high temperature region, the first bimetal disc 5 raises the actuator rod 10. The potential at the contacts A, B is as shown in the Table 1. The condition assumed in the medium temperature region is shown in FIG. 3*b* while that in the high temperature region is shown in FIG. 3*c*.

Figure 4A:
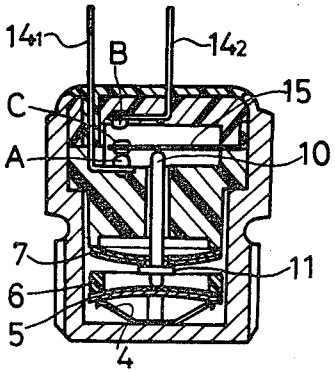
FIG. 4*a* is a longitudinal section of still another embodiment of the invention.
Figure 4B:
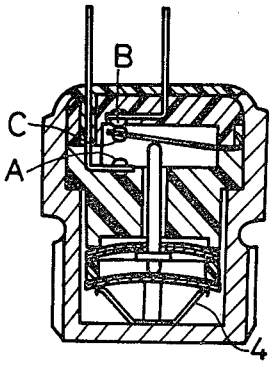
FIGS. 4*b* and 4*c* are similar longitudinal sections of the embodiment shown in FIG. 4*a,* illustrating different operative conditions.
Figure 4C:
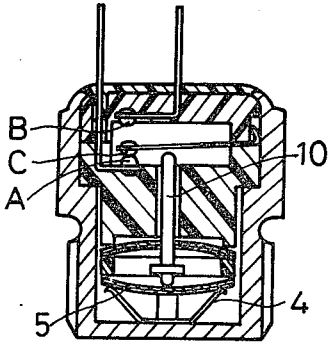

In an embodiment shown in FIG. 4*a*, the Belleville spring 4 has four limbs rather than five limbs shown in the previous embodiments, and the spacer 6 is in the form of a ring, with the actuator rod 10 being formed with the flange 11. The second bimetal disc 7 exhibits a temperature-deformation characteristic which is similar to that of the disc shown in FIG. 2*a*. The first bimetal disc 5 exhibits a deformation characteristic such that it produces a reduced stroke to raise the rod 10 upward in its low and medium temperature region while it flexes to the opposite side in the high temperature region to produce a further reduction in the stroke by which the rod 10 is raised. In the low temperature region, the second bimetal disc 7 tends to force the rod 10 down, which tendency is resisted by the first bimetal disc 5. As a result of the bending force of the both discs 5, 7 applied to the Belleville spring 4, the latter is greatly compressed, whereby the actuator rod 10 does not raise the spring switch arm 15. In the medium temperature region, the second bimetal disc 7 flexes to the opposite side, and the flexure of the first bimetal disc 5 reduces, whereby the Belleville spring 4 is allowed to expand to its maximum extent. This causes the first bimetal disc 5 to move upward and thus causes the actuator rod 10 to be driven upward through an increased stroke, whereby the spring switch arm 15 is driven upward to bring the contact C into engagement with the contact B. In the high temperature region, the expansion of the Belleville spring 4 remains unchanged, but the first bimetal disc 5 flexes to the opposite side, whereby the actuator rod 10 moves down until the contact C engages the contact A. A switching operation achieved in this embodiment depending on the temperature region is summarized in a Table 2 below.

TABLE 2

| Temp. region | Fig. | Potential of lead strips $14_1$ | $14_2$ |
|---|---|---|---|
| No. 1 low | 4a | ground | X |
| No. 2 low to medium | | X | X |
| No. 3 medium | 4b | X | ground |
| No. 4 medium to high | | X | X |
| No. 5 high | 4c | ground | X |

In the above Table, X represents a potential applied to the lead strips $14_1$, $14_2$.

In this embodiment, if the switch operates over temperature regions No. 1–3 or 3–5, the potential of the lead strips $14_1$, $14_2$ corresponds to the number of the temperature region. When the switch is to cover all the temperature regions No. 1–5, it is necessary to determine the number of the temperature region by comparing the prevailing potential against a past history in which a change in the potential of the lead strips $14_1$, $14_2$ is plotted beginning from a starting point such as a cold starting of the engine, for example, for which the number of the temperature region can be determined uniquely.

Figure 5A:
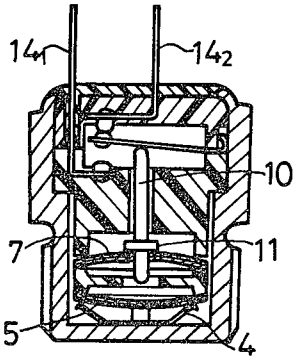
FIG. 5*a* is a longitudinal section of a still further embodiment of the invention.
Figure 5B:
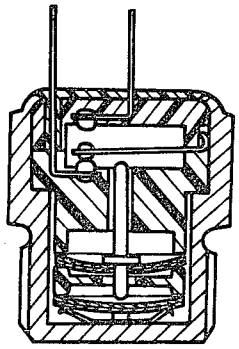
FIGS. 5*b* and 5*c* are similar longitudinal sections of the embodiment shown in FIG. 5*a,* illustrating different operative conditions.
Figure 5C:
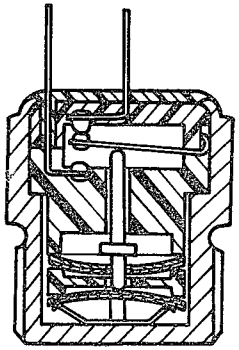

In an embodiment shown in FIG. 5*a*, the second bimetal disc 7 supports the lower surface of the flange 11. The temperature-deformation characteristic of the first and the second bimetal disc 5, 7 corresponds to that of the discs 5, 7 shown in FIG. 1*a*, respectively. The switching operation with a temperature change of this embodiment differs from that shown in FIG. 4*a*, and is summarized in a Table 3 below.

TABLE 3

| Temp. region | Fig. | Potential of lead strips $14_1$ | $14_2$ |
|---|---|---|---|
| No. 1 low | 5a | X | ground |
| No. 2 low to medium | | X | X |
| No. 3 medium | 5b | ground | X |
| No. 4 medium to high | | X | X |
| No. 5 high | 5c | X | ground |

Figure 6A:
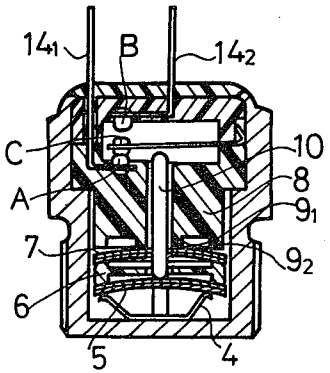
FIG. 6*a* is a longitudinal section of yet another embodiment of the invention.
Figure 6B:
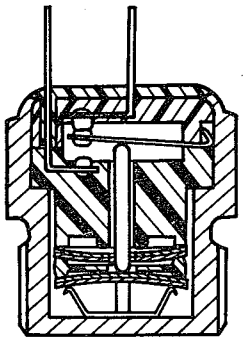
FIGS. 6*b* and 6*c* are similar longitudinal sections of the embodiment shown in FIG. 6*a,* illustrating different operative conditions.
Figure 6C:
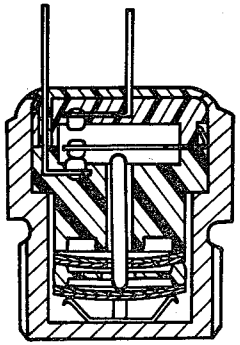

In an embodiment shown in FIG. 6*a*, the actuator guide 8 is formed with annular projections $9_1$, $9_2$. In the low temperature region, the second bimetal disc 7 bears against the projection $9_1$ and the spacer 6 to force the latter down, as shown in FIG. 6*a*. In the medium temperature region, the second bimetal disc 7 flexes to the opposite side. The first bimetal disc 5 flexes to the opposite side in the high temperature region. A switching operation which takes place with this embodiment is as indicated in the Table 2. The condition of the switch assumed in the medium temperature region is shown in FIG. 6*b* while that in the high temperature region in FIG. 6*c*.

Figure 7A:
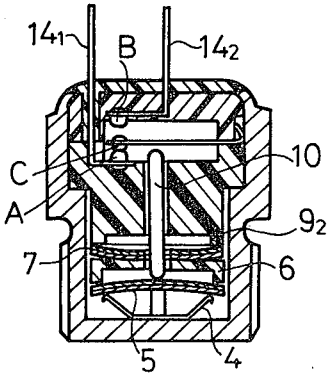
FIG. 7*a* is a longitudinal section of an yet further embodiment of the invention.
Figure 7B:
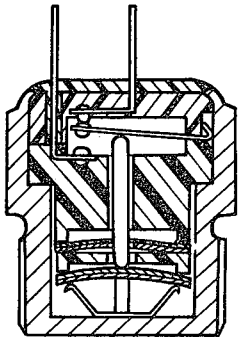
FIGS. 7*b* and 7*c* are similar longitudinal sections of the embodiment shown in FIG. 7*a,* illustrating different operative conditions.
Figure 7C:
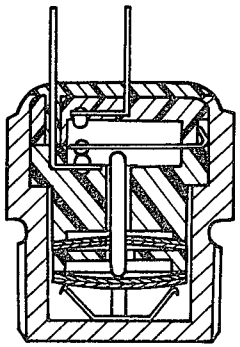

In an embodiment shown in FIG. 7*a*, the second bimetal disc 7 bears against the projection $9_2$ on the guide 8 and the spacer 6, forcing the latter down, as shown in FIG. 7*a*. The first bimetal disc 5 flexes to the opposite side in the high temperature region. The second bimetal disc 7 flexes to the opposite side in the medium temperature region. A switching operation which takes place with this embodiment is as indicated in the Table 2. The condition of the switch assumed in the medium temperature region is shown in FIG. 7*b* while that in the high temperature region in FIG. 7*c*.

What we claim is:

1. A temperature responsive switch comprising a hollow casing member which is open at its one end;

a cover member which closes the opening;

a guide member for dividing an internal space defined by the casing and the cover member into a first and a second internal space, the guide member being centally formed with a guide opening for an actuator;

a first bimetal disc disposed in the first internal space;

a second bimetal disc disposed in the first internal space and having an opening centrally formed therein to pass an actuator;

a spacer interposed between the first and the second bimetal disc and having an opening formed therein to pass an actuator;

spring means disposed in the first inner space for supporting the first bimetal disc;

an actuator member extending through the guide opening and the openings formed in the second bimetal disc and the spacer;

resilient switching arm disposed in the second internal space and extending to traverse the axis of the guide opening;

and a plurality of electrical contact members disposed on the path of movement of the switching arm and spaced from each other.

2. A temperature responsive switch according to claim 1 in which the plurality of electrical contact members are two in number and are disposed on the opposite sides of the switching arm.

3. A temperature responsive switch according to claim 1 in which the guide member is formed with an annular projection on its end face opposing the second bimetal disc, adjacent to the outer periphery thereof.

4. A temperature responsive switch according to claim 3 in which the guide member is also formed with another projection on its end face opposing the second bimetal disc at a location around the guide opening.

5. A temperature responsive switch according to claim 1 in which the spacer is formed with an annular projection on its end face opposing the first bimetal disc, adjacent to the outer periphery thereof.

6. A temperature responsive switch according to claim 1 in which the spacer is also formed with another annular projection on its end face opposing the second bimetal disc, adjacent to the outer periphery thereof.

7. A temperature responsive switch according to claim 1 in which the spacer is in the form of a ring.

8. A temperature responsive switch according to claim 1 in which the actuator member is formed with a flange which is located intermediate the first and the second bimetal disc for abutment against the second bimetal disc.

9. A temperature responsive switch according to claim 1 in which the actuator member is formed with a flange disposed between the guide member and the second bimetal disc, for abutment against the second bimetal disc.

10. A temperature responsive switch according to claim 1 in which the spring means is in the form of a Belleville spring.

11. A temperature responsive switch according to claim 10 in which the Belleville spring has a plurality of limbs extending along a frusto-conical surface and a common flat plate portion to which the limbs are connected.

12. A temperature responsive switch according to claim 1 in which the outer wall of the casing member is threaded.

13. A temperature responsive switch comprising a casing member which is open at one end and having a threaded external wall surface;

a cover member for closing the opening;

a guide member for dividing an internal space defined by the casing member and the cover member into a first internal space located nearer the bottom of the casing member and a second internal space located nearer the cover member, the guide member being formed with a guide opening aligned with the axis thereof for providing a communication between the both internal spaces, the guide member being formed with an annular projection on its end face opposing the first inner space and adjacent to the outer periphery thereof;

spring means disposed on the bottom of the casing member;

a first bimetal disc placed on the spring means;

a spacer placed on the first bimetal disc and having an annular projection for abutment against the outer peripheral portion of the first bimetal disc and an opening to pass an actuator therethrough;

a second bimetal disc placed on the spacer and disposed in abutment against the annular projection on the guide member and being centrally formed with an opening to pass an actuator therethrough;

an actuator member extending through the guide member, the second bimetal disc and the spacer;

a first fixed electrical contact member secured to an end face of the guide member which opposes the cover member;

a second fixed electrical contact member secured to the cover member in opposing relationship with the first contact member;

a resilient switching arm having a movable end which is located intermediate the first and the second fixed contact member, a portion of the switching arm between the movable end and the opposite end where it is secured being located above the opening formed in the guide member;

and a movable electrical contact secured to the movable end of the switching arm.

14. A temperature responsive switch according to claim 13 in which the spacer is also formed with another annular projection for abutment against the outer peripheral portion of the second bimetal disc.

15. A temperature responsive switch according to claim 13 in which the actuator member is formed with a flange which is disposed between the first and the second bimetal disc and which is adapted to bear against the second bimetal disc.

16. A temperature responsive switch according to claim 13 in which the actuator member is formed with a flange which is disposed intermediate the guide member and the second bimetal disc and which is adapted to bear against the second bimetal disc.

* * * * *